US007395987B2

(12) United States Patent
Lindquist et al.

(10) Patent No.: US 7,395,987 B2
(45) Date of Patent: Jul. 8, 2008

(54) APPARATUS AND APPERTAINING METHOD FOR UPFINDING IN SPINNING PROJECTILES USING A PHASE-LOCK-LOOP OR CORRELATOR MECHANISM

(75) Inventors: Erik Lindquist, Minneapolis, MN (US); Ruth D. Kreichauf, River Falls, WI (US)

(73) Assignee: Honeywell International Inc., Morristown, NJ (US)

( * ) Notice: Subject to any disclaimer, the term of this patent is extended or adjusted under 35 U.S.C. 154(b) by 194 days.

(21) Appl. No.: 11/189,905

(22) Filed: Jul. 26, 2005

(65) Prior Publication Data

US 2007/0023567 A1 Feb. 1, 2007

(51) Int. Cl.
*F42B 15/01* (2006.01)
*F41G 7/00* (2006.01)

(52) U.S. Cl. ..... 244/3.21; 244/3.1; 244/3.11; 244/3.15

(58) Field of Classification Search ..... 244/3.1–3.3; 702/127, 150, 151
See application file for complete search history.

(56) References Cited

U.S. PATENT DOCUMENTS 3,527,429 A 9/1970 Hawes, Jr. et al.
3,844,506 A * 10/1974 Stavis et al. ..... 244/3.15
3,891,161 A * 6/1975 Hermann ..... 244/3.12
3,897,918 A 8/1975 Gulick, Jr. et al.
4,264,907 A 4/1981 Durand, Jr. et al.
4,646,990 A * 3/1987 Cleveland, Jr. ..... 244/3.21
4,791,573 A * 12/1988 Zemany et al. ..... 244/3.2
4,848,158 A * 7/1989 Egli et al. ..... 244/3.21
4,973,013 A * 11/1990 Klaus, Jr. ..... 244/3.16
5,072,890 A * 12/1991 Klaus et al. ..... 244/3.16
5,114,094 A * 5/1992 Harris ..... 244/3.22
5,127,604 A * 7/1992 Klaus, Jr. ..... 244/3.16
5,372,334 A 12/1994 Cuadros
5,414,430 A * 5/1995 Hansen ..... 244/3.21
5,593,109 A * 1/1997 Williams ..... 244/3.21

(Continued)

FOREIGN PATENT DOCUMENTS

DE 3529277 3/1987

(Continued)

OTHER PUBLICATIONS

D.J. Lucia, "Estimation of the Local Vertical State for a Guided Munition Shell with an Embedded GPS/MicroMechanical Inertial Navigation System", MIT Masters of Science Thesis, May 1995.

(Continued)

*Primary Examiner*—Bernarr E Gregory
(74) *Attorney, Agent, or Firm*—Fogg & Powers, LLC

(57) ABSTRACT

The invention relates to the field of gun-launched guidance systems and to a navigation system based on inertial sensors mounted in a spinning projectile using at least one rotation sensing device with input components perpendicular to the spinning body's longitudinal axis, and an appertaining method for upfinding. The phase of the sinusoidal angular rate as detected by a phase-locked loop or correlator is used to determine the local vertical orientation. This invention may be used to align the inertial navigation system in spinning projectiles in ballistic trajectories, which can include artillery shells, satellites or underwater torpedoes.

19 Claims, 6 Drawing Sheets

U.S. PATENT DOCUMENTS

| | | | | |
|---|---|---|---|---|
| 5,805,102 | A * | 9/1998 | Heap et al. | 244/3.14 |
| 5,835,056 | A * | 11/1998 | Heap et al. | 244/3.14 |
| 5,886,257 | A | 3/1999 | Gustafson et al. | |
| 6,016,990 | A * | 1/2000 | Small | 244/3.11 |
| 6,163,021 | A * | 12/2000 | Mickelson | 244/3.2 |
| 6,450,442 | B1 * | 9/2002 | Schneider et al. | 244/3.14 |
| 6,572,052 | B1 * | 6/2003 | Hansen | 244/3.11 |
| 6,596,976 | B2 * | 7/2003 | Lin et al. | 244/3.2 |
| 6,886,774 | B2 * | 5/2005 | Lamorlette | 244/3.15 |
| 2005/0001088 | A1 * | 1/2005 | Lamorlette | 244/3.15 |

FOREIGN PATENT DOCUMENTS

| | | |
|---|---|---|
| DE | 3832389 | 4/1990 |
| EP | 1048929 | 11/2000 |
| IL | 129654 | 4/1999 |

OTHER PUBLICATIONS

Gustafson et al, "Autonomous Local Vertical Determination for Guided Artillery Shells", Autonomous Local Vertical Determination for Guided Artillery Shells, D. Gustafson, Draper Laboratory; D. Lucia, Falcon AFB, pp. 213-221 52nd Annual Meeting Proceedings "Navigational Technology for the Third Millennium" Jun. 19-21, 1996, Royal Sonesta Hotel, Cambridge Massachusetts.

Bar-Itzhack et al, "New Inertial Azimuth Finder Apparatus", AIAA Journal of Guidance, Control and Dynamics, vol. 24, No. 2, Mar.-Apr. 2001, pp. 206-213.

Li et al, "Introduction to Phase-Lock Loop System Modeling", Aug. 18, 2000.

Mansukhani, "Phase Lock Loop Stability Analysis", Applied Microwave & Wireless (2000), pp. 30-38 (including advertisements).

* cited by examiner

APPARATUS AND APPERTAINING METHOD FOR UPFINDING IN SPINNING PROJECTILES USING A PHASE-LOCK-LOOP OR CORRELATOR MECHANISM

BACKGROUND OF THE INVENTION

The invention relates to the field of gun-launched guidance systems and to a navigation system based on inertial sensors mounted in a spinning projectile using at least one rotation sensing device with input components perpendicular to the spinning body's longitudinal axis, or at least one acceleration sensing device with input components along the spinning body's longitudinal axis.

A projectile in flight follows a trajectory defined by an interaction of gravity, aerodynamics, and mechanical forces due to spin, shape and possible steering fins. The projectile's flight phases can be described in terms of a pre-launch phase, launch phase, and ballistic phase.

In the pre-launch phase, before launch of the projectile (e.g., an artillery shell), enough navigation information is available to perform a pre-launch alignment of the on-board inertial navigation system. The launch phase is characterized by high-G forces that occur during launch. During the launch phase, most navigation systems will not be able to navigate due to these high-G forces, and it is necessary to perform a post-launch alignment of the inertial system, as described below.

After the launch phase, i.e., at the start of the ballistic phase, the navigation system has to be aligned before it can navigate. At launch, parameters such as elevation angle, muzzle velocity, heading and spin rate are known to an extent needed for a coarse alignment of the navigation system. The roll angle (the angle about the projectile's longitudinal axis, or axis roughly in parallel with its direction of travel) of the projectile is however not known. Due to the projectile's spin, the roll angle is also rapidly changing. The roll angle must therefore be established to a degree that the coarse alignment accuracy provides a sufficient initialization for a successful subsequent fine alignment phase. This process of estimating the roll angle in a spinning projectile is referred to as 'Upfinding'.

During the ballistic phase of the trajectory, the pitch angle of the shell will decrease at a small angular rate. When the shell spins, the pitch rate can be observed in an axis perpendicular to the spin axis as a sinusoidal rate, where the maximum and minimums occur when that axis is in the horizontal plane, see FIG. 1. The phase of the sinusoidal rate in an axis perpendicular to the projectile's spin axis can therefore be used to indicate the shell's roll angle. An accelerometer with its input axis co-aligned with the shell's spin axis and mounted off center in the shell will pick up a sinusoidal Coriolis acceleration due to the interaction of its velocity vector around the shell's center and the change in the shell's pitch rate. The phase of the sinusoidal Coriolis acceleration can also be used to indicate the shell's roll angle.

Inertial sensors that are used to determine positional and orientation parameters, including the time derivatives of these parameters, generally exceed their operational ranges during the high-g shock at launch.

In an existing solution to the upfinding problem, a pitch-(or yaw-angle gyroscope is positioned in the shell to detect rotation in an axis perpendicular to the spin axis. The pitch-angle gyroscope detects the change in the shell's pitch angle as the shell travels in a ballistic trajectory. As the shell spins around its longitudinal axis, the gyroscope in the perpendicular axis picks up the shell's pitch rate as a sine wave. The phase of this sine wave is directly related to the shell's roll angle and can be used to estimate the roll angle. In particular, as the input axis of the gyroscope points upward or downward, the detected rotation is approximately zero; when the axis of the gyroscope is horizontal, the gyroscope senses maximum positive or negative pitch rate.

Alternately, an accelerometer with its input axis along the shell's longitudinal axis can use the Coriolis acceleration to estimate the shell's roll angle. The measured Coriolis acceleration will also exhibit a sine wave related to the shell's roll angle.

The existing solutions to the upfinding problem are described, e.g., in Lucia, D. J., "Estimation of the Local Vertical State for a Guided Munition Shell with an Embedded GPS/Micro-Mechanical Inertial Navigation System", MIT Masters of Science Thesis, May 1995 ("Lucia"), and Gustafson, D. E., Lucia, D. J. "Autonomous Local Vertical Determination for Guided Artillery Shells", Autonomous Local Vertical Determination for Guided Artillery Shells, D. Gustafson, Draper Laboratory; D. Lucia, Falcon AFB, pp213-221 52nd Annual Meeting Proceedings "Navigational Technology for the Third Millennium" Jun. 19-21, 1996, Royal Sonesta Hotel, Cambridge, Mass. ("Gustafson & Lucia").

U.S. Pat. No. 5,886,257 describes an apparatus and a method for making an autonomous local vertical determination for a ballistic body using recursive Kalman filtering to determine the roll angle (local vertical direction).

U.S. Pat. No. 5,372,334 describes the use of a retroreflector mounted on the projectile to implement an improved local vertical reference determination.

U.S. Pat. No. 6,163,021 describes a navigation system for spinning projectiles utilizing a magnetic spin sensor and a GPS/INS Kalman filter.

An article by Bar-Itzack, I. Y., Reiner, J. and Naroditsky, M., titled "New Inertial Azimuth Finder Apparatus", AIAA Journal of Guidance, Control and Dynamics, Vol. 24, No 2, March-April 2001, pp 206-213 cites Israeli Patent 129654, filed Apr. 28, 1999, titled "Method and Apparatus for Determining the Geographical Heading of a Body," that discusses finding a geographical north of a body.

While these references disclose various ways of finding a solution to the upfinding problem, none of them disclose an optimized system utilizing a phase-locked-loop (PLL) or a correlator or the enhancement from complementary filtering the roll angle with roll rate.

SUMMARY OF THE INVENTION

The objective of the invention is to provide a solution to the upfinding problem in spinning projectiles by using a PLL or correlator mechanism that can be enhanced with a complementary filter. The new upfinding solutions according to the invention are simple and work in a general environment by using either accelerometers or gyros in the upfinding process under appropriate conditions.

The phase of the sinusoidal signal from an inertial sensor as detected by a phase-locked loop or a correlator is used to determine the local vertical orientation. This invention may be used to align the inertial navigation system in spinning projectiles in ballistic trajectories, which can include, among other things, artillery shells, satellites and underwater torpedoes.

A navigation system may be mounted in a spinning body using at least one angular sensing device measuring an angular rate perpendicular to the body's spin axis or Coriolis acceleration off-center along the body's spin axis. The measurements from the inertial sensing device exhibit a sine-wave pattern, where the sine wave's phase angle is in synchronization with the spinning body's roll angle, which relates to the local vertical. A PLL or correlator may then be used to track the phase of the sinusoidal wave.

DESCRIPTION OF THE DRAWINGS

The invention is explained in greater detail below and references the following drawings.

DETAILED DESCRIPTION OF THE PREFERRED EMBODIMENTS

Upfinding System

Figure 1B:
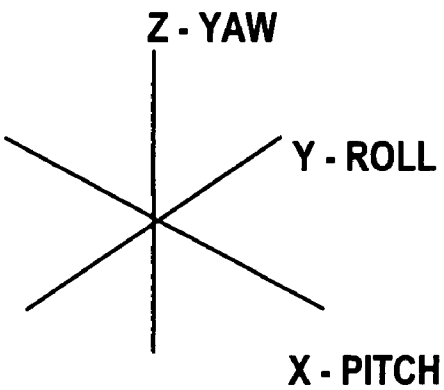
FIG. 1B is a diagram illustrating the various rotational axes in a three-dimensional system.
Figure 1A:
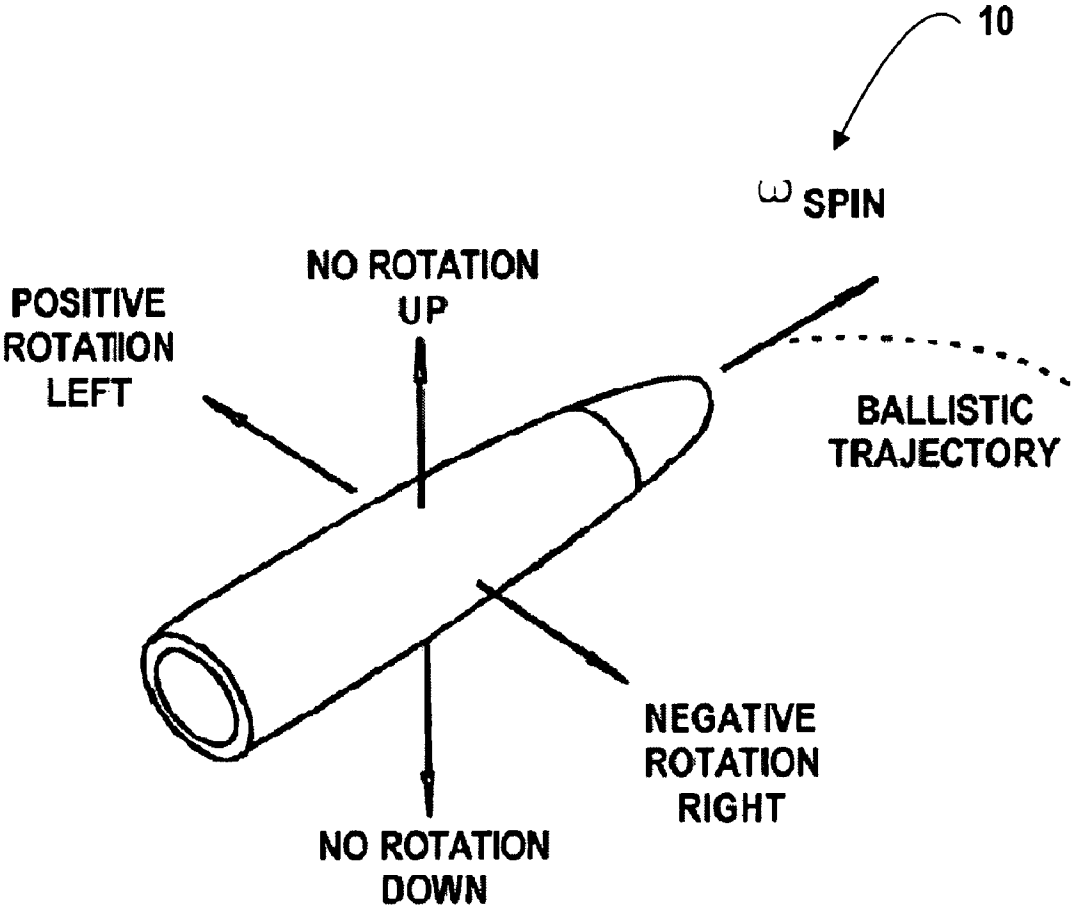
FIG. 1A is a pictorial diagram of a projectile illustrating rotational aspects.

Various preferred embodiments of the invention are described below for solving the upfinding problem using inertial sensors. As background, FIG. 1A illustrates a projectile 10 that has been launched on a ballistic trajectory and has some degree of rotation in the three axes (pitch, roll and yaw) illustrated in FIG. 1B.

Figure 2:
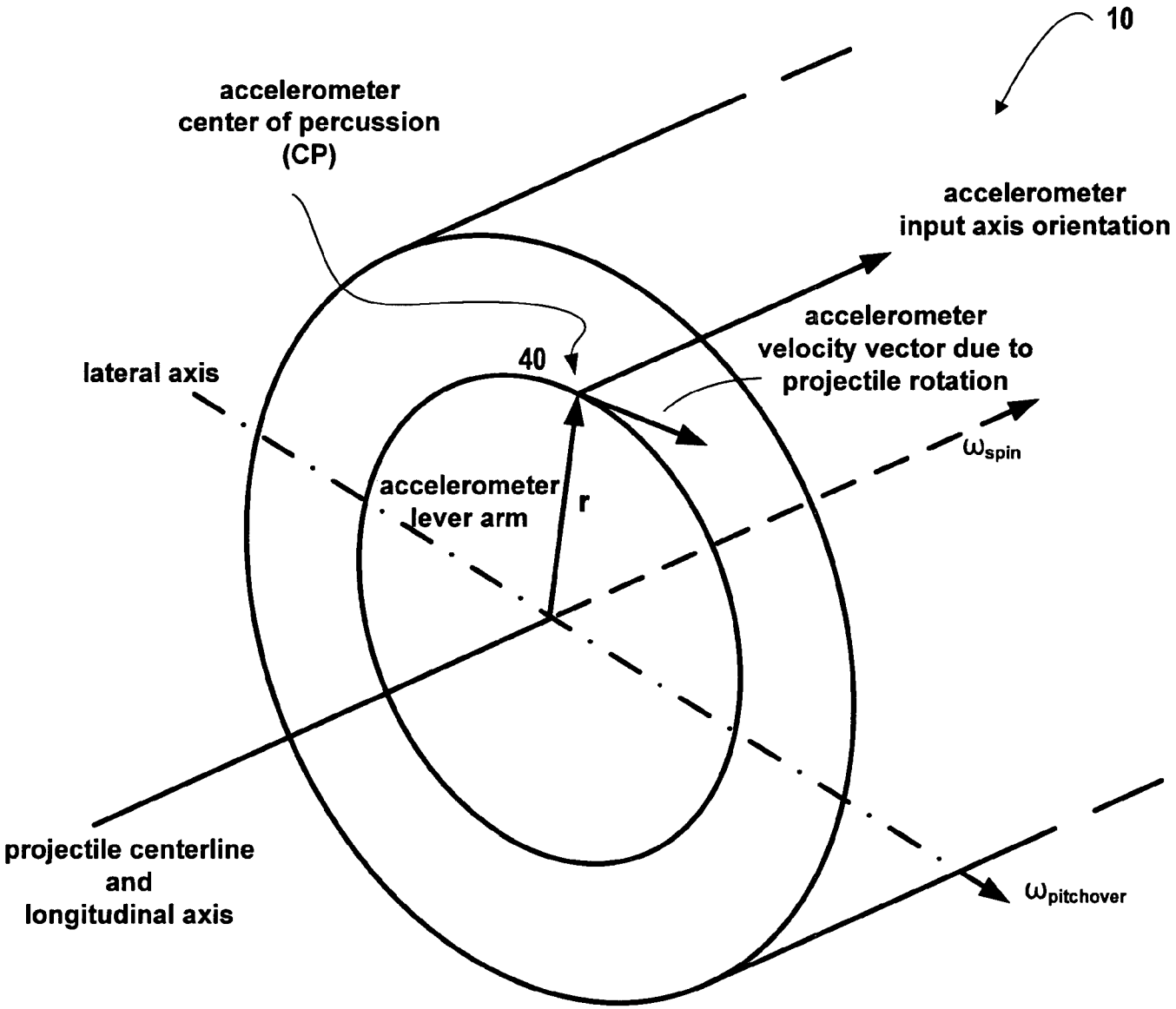
FIG. 2 is a pictorial diagram illustrating motion components of the accelerometer located on the projectile.

FIG. 2 illustrates the projectile center line and the longitudinal axis about which it rotates $\omega_{spin}$, as well as the location of an inertial sensor 40 and the lateral access illustrating the pitch of the projectile $\omega_{pitchover}$.

Figure 3:
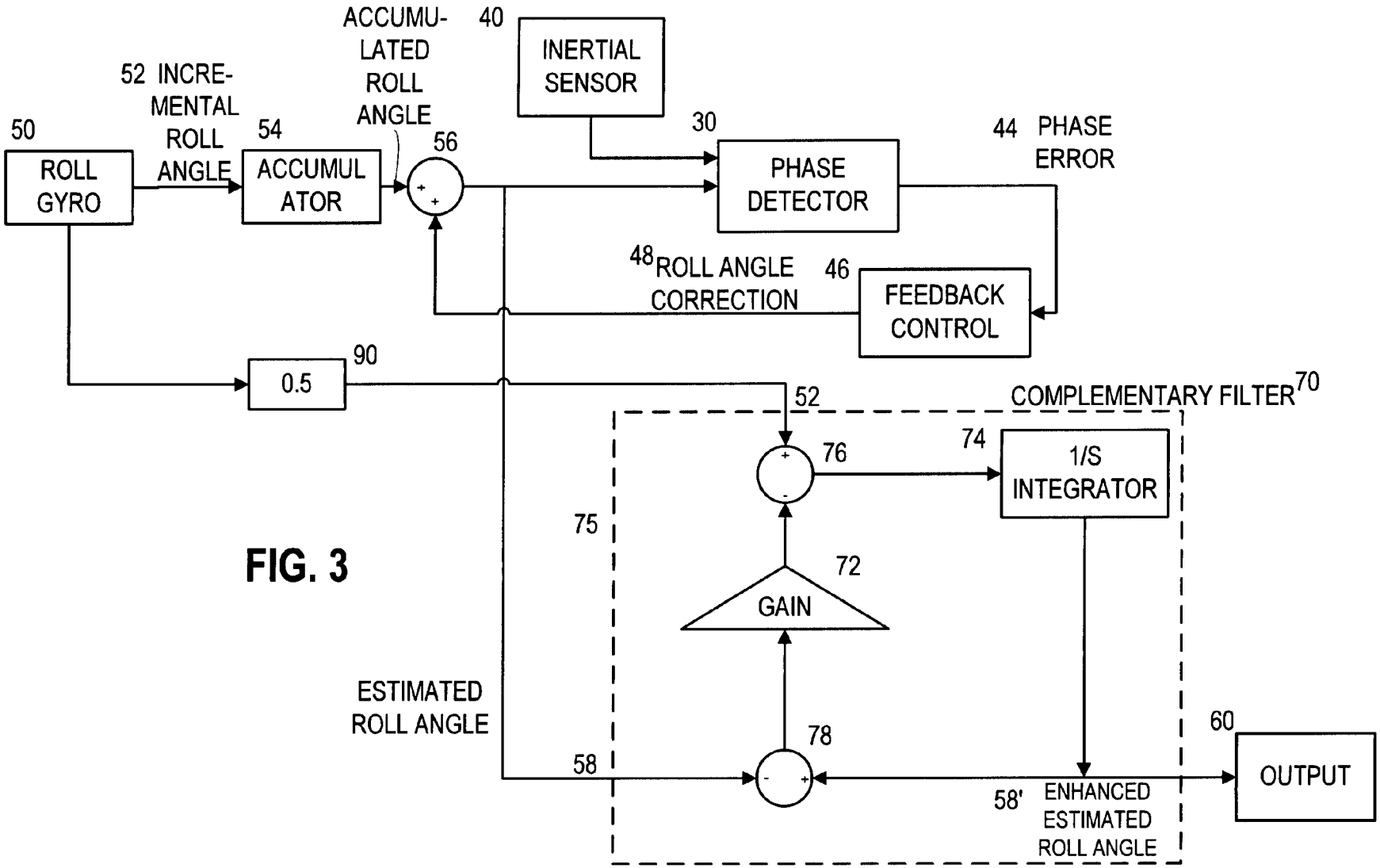
FIG. 3 is a block diagram illustrating the overall architecture of an upfinding system including the use of a complementary filter.
Figure 4:
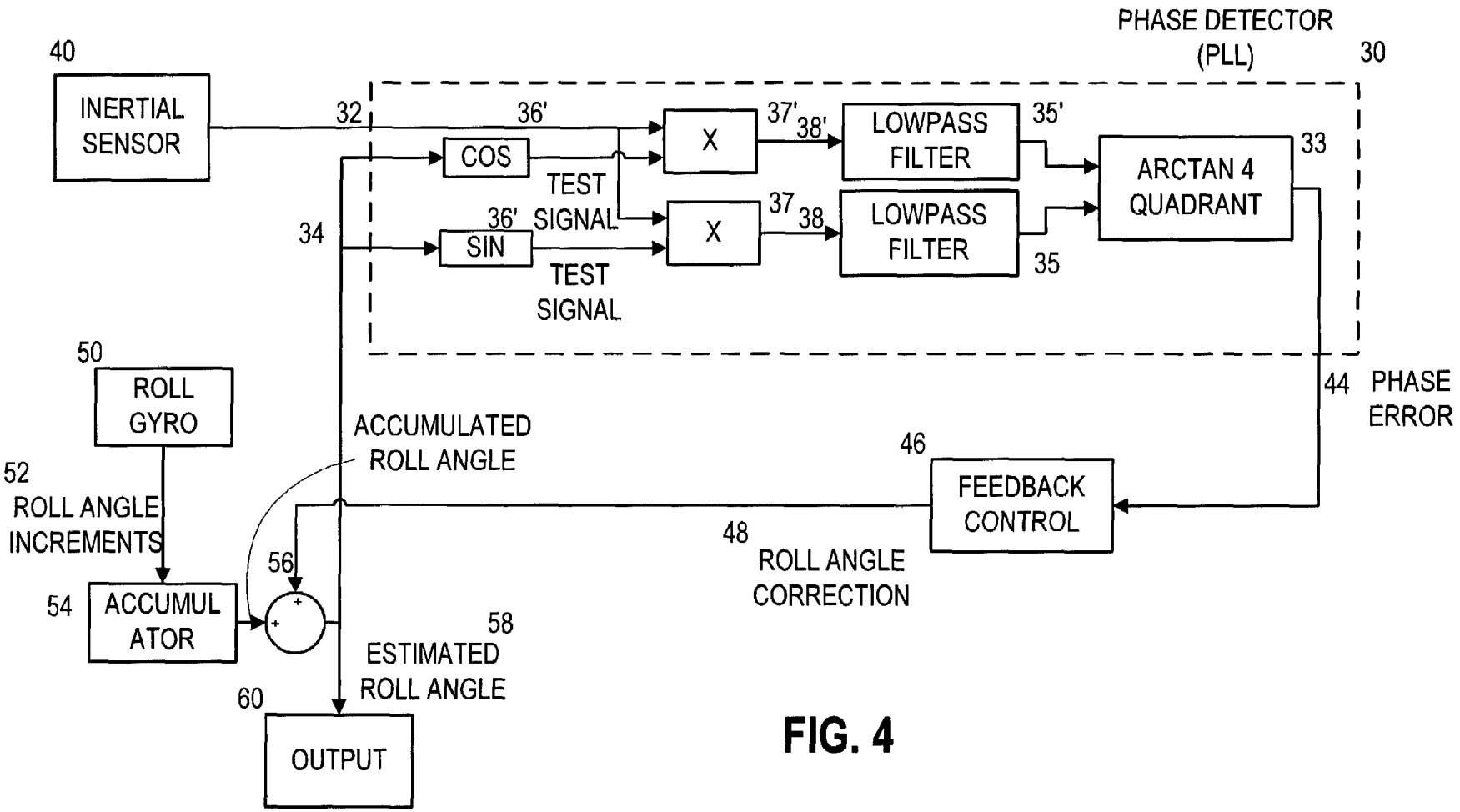
FIG. 4 is a block diagram showing the inputs, outputs, and feedback mechanisms for the PLL circuit and illustrating one implementation of a phase detector.

As shown in FIG. 4, one embodiment of the invention utilizes a Costas loop PLL as a phase detector 30 in combination with, optionally, a complementary filter 70 (FIG. 3) to detect the phase of the sinusoidal rate/acceleration signal identifying the roll angle based on the inertial sensor 40 (gyro or accelerometer) information.

Another embodiment of the invention utilizes a correlator 80 (FIG. 5) as the phase detector 30 in combination with, optionally, a complementary filter 70 to detect the phase of the sinusoidal rate/acceleration signal identifying the roll angle based on inertial sensor 40; the choice between using pitch gyro information versus accelerometer information for the inertial sensor 40 is dependent on the application itself. The phase detector 30 estimates the phase error or equivalently the roll angle correction of the sinusoidal measurement signal 32 obtained from the inertial sensor 40.

As described below, all methods to detect the roll angle directly from the sinusoidal measurement signal show a significant sine-wave component coming from the projectile's motion motion. To dampen the error from the nutation and to smoothen the result, a complementary filter 70 using the roll rate from the roll gyro 50 may be inserted after the phase detector 30. The complementary filter 70 may also provide a coarse estimation of the roll gyro's 50 scale factor error.

Phase-Lock Loop

Referring to FIG. 4, in an embodiment of the invention, the PLL 30 is designed as a Costas loop. For detecting the phase of the small amplitude, noisy sine wave (such as that coming from the inertial sensor 40), the known Costas loop is preferred over simpler formulations of a PLL due to the inherent amplitude normalization when the in-phase and out-of-phase signals are compared in the arctan function block.

The inertial sensor(s) 40 generates a sinusoidal measurement signal 32 in response to rotation by the projectile. A roll gyro 50 combined with an accumulator 54 provides a coarse estimation of the roll angle. The remaining circuitry provides correction to the estimation of the roll angle.

After the sinusoidal measurement signal 32 is multiplied 37, 37' with the sine 36 and cosine 36' of the estimated roll angle 34, the resulting signals in each branch 38, 38' are the sum of two signals, one with the frequency equal to the sum of the measurement and the accumulated roll angle, and one with the difference. The sum frequencies do not contribute to the detection of the measurement signal's phase, so they are attenuated in low-pass filters 40, 40', one in each branch.

The phase error between the measurement 32 and the estimated accumulated roll angle 34 may be computed by a four quadrant arctan function 33. To make the loop lock on to the measurement signal 32, the detected roll angle error correction 44 may be fed back to adjust the accumulated roll angle, using feedback control 46 that produces the roll angle correction value 48. This permits control of the estimated roll angle 58 so that the error estimated by the arctan computation results in a zero phase error between the measurement 32 and the estimated roll angle 58.

Correlator-Based System

Referring to FIGS. 5 and 6A-D, an alternative method to estimate the roll angle is to use a correlator 80 instead of a PLL. The principle is to correlate the sinusoidal measurement signal 32 from the inertial sensors 40 carrying the roll angle phase information (FIG. 6A) with a sinewave of known phase and adjust the known phase until the sine waves' phase coincide. The phase and thus the roll angle is then known.

Figure 6A:
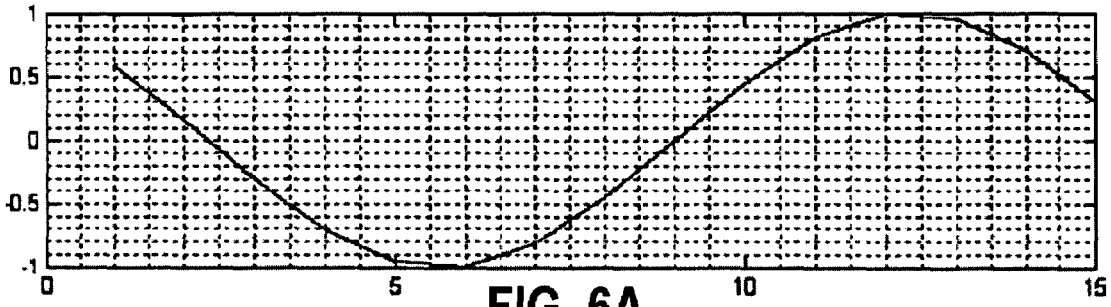
FIGS. 6A-D are graphs showing the correlation of measurement signals.
Figure 6B:
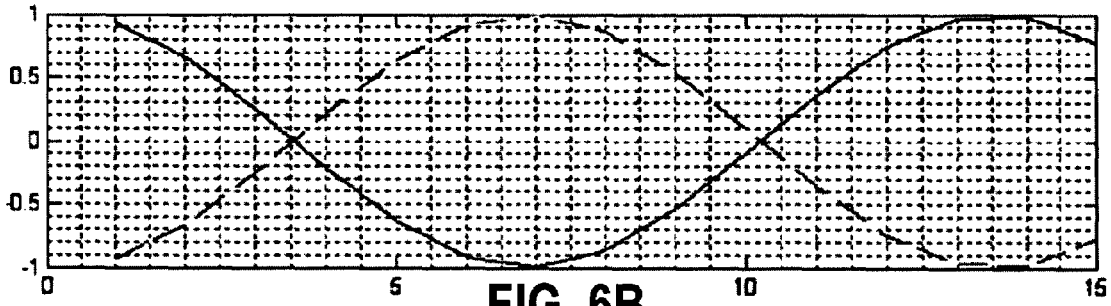
Figure 6C:
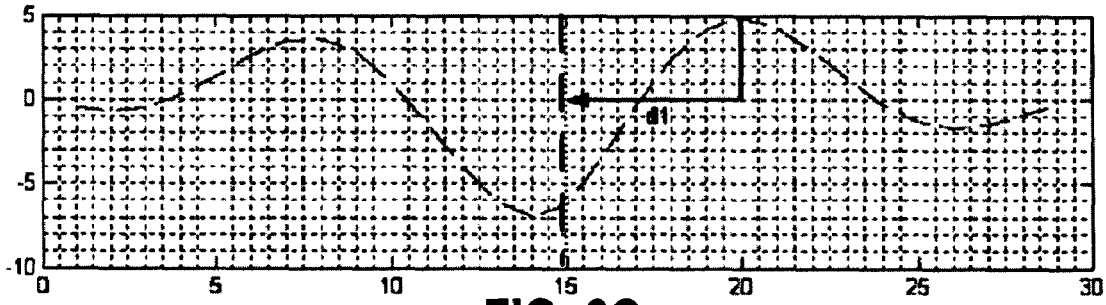

Using just one correlator 80 will not tell the controller for the phase adjustment of the known sinewave in which direction to apply control. A scheme of two correlators 80 fed with sinewaves 39, 39' that lead and lag the known phase with an equal amount is the solution used in this embodiment (FIG. 6B). The controller principles are then to drive the two correlator 80 outputs until they lie symmetrical around the midpoint of the correlator window, indicating that the measurement signal's phase coincides with the phase of the estimated roll angle (FIGS. 6C, D).

The total estimated roll angle 58 is made up from the accumulation of the roll gyro 50 output, representing the raw continuously increasing roll angle 52 and the corrections generated by the correlator control loop 40.

A segment or measurement window of the sinusoidal signal (FIG. 6A) is correlated with two phase shifted segments of a test sine-wave signal 39, 39' with a known phase (FIG. 6B). The phase shift of the two segments is symmetric, i.e., + and −90 degrees. The segments of the sensor signal 32 and the test signals 39, 39' must contain enough samples to describe at least one rotation. The cross-correlation returns two sequences (FIGS. 6C, D) of length 2*N−1, where N is the number of samples in the measurement window.

Figure 6D:
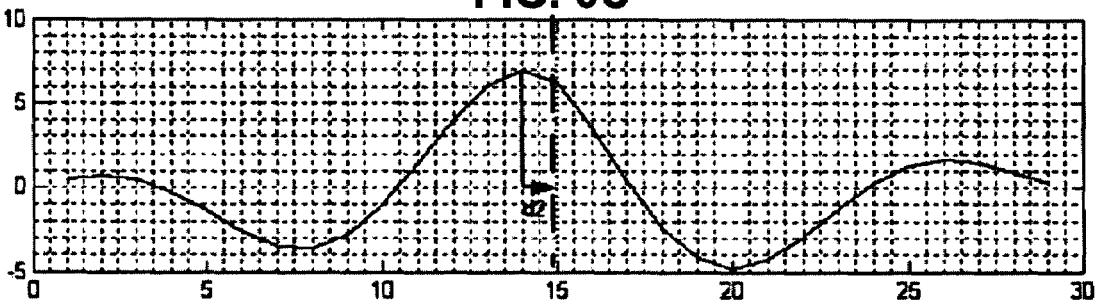

An error is calculated from the maximums of the two phase shifted correlation signals and the symmetry point of the measurement window, such that the Error=(d1−d2)/2, where:

d1 represents the number of samples that the +90 deg shifted test signal deviates from the symmetry point N at which the maximum should occur if the measurement signal's phase coincides with the phase of the estimated roll angle (FIG. 6C); and d2 represents the number of samples that the −90 deg shifted test signal deviates from the symmetry point N at which the maximum should occur if the measurement signal's phase coincides with the phase of the estimated roll angle (FIG. 6D).

This sample error is then converted into a phase error 44 and fed back through a feed back control 46 to produce a phase correction 48 and to drive the phase error of the test signal to zero which means to drive the two correlator 80 outputs until they lie symmetrical around the midpoint of the correlator window.

Complementary Filter

A projectile's motion is greatly influenced by aerodynamic forces. These forces create torques that make the spinning projectile precess and nutate. The precession and nutation motion is picked up by the pitch and yaw gyros and also in the Coriolis acceleration experienced by the longitudinal accelerometer. The result is that the phase angle determination by the PLL 30 and the correlator 80 will have the precession/nutation overlaid on the roll angle determination as a sine wave of several degrees amplitude.

Figure 5:
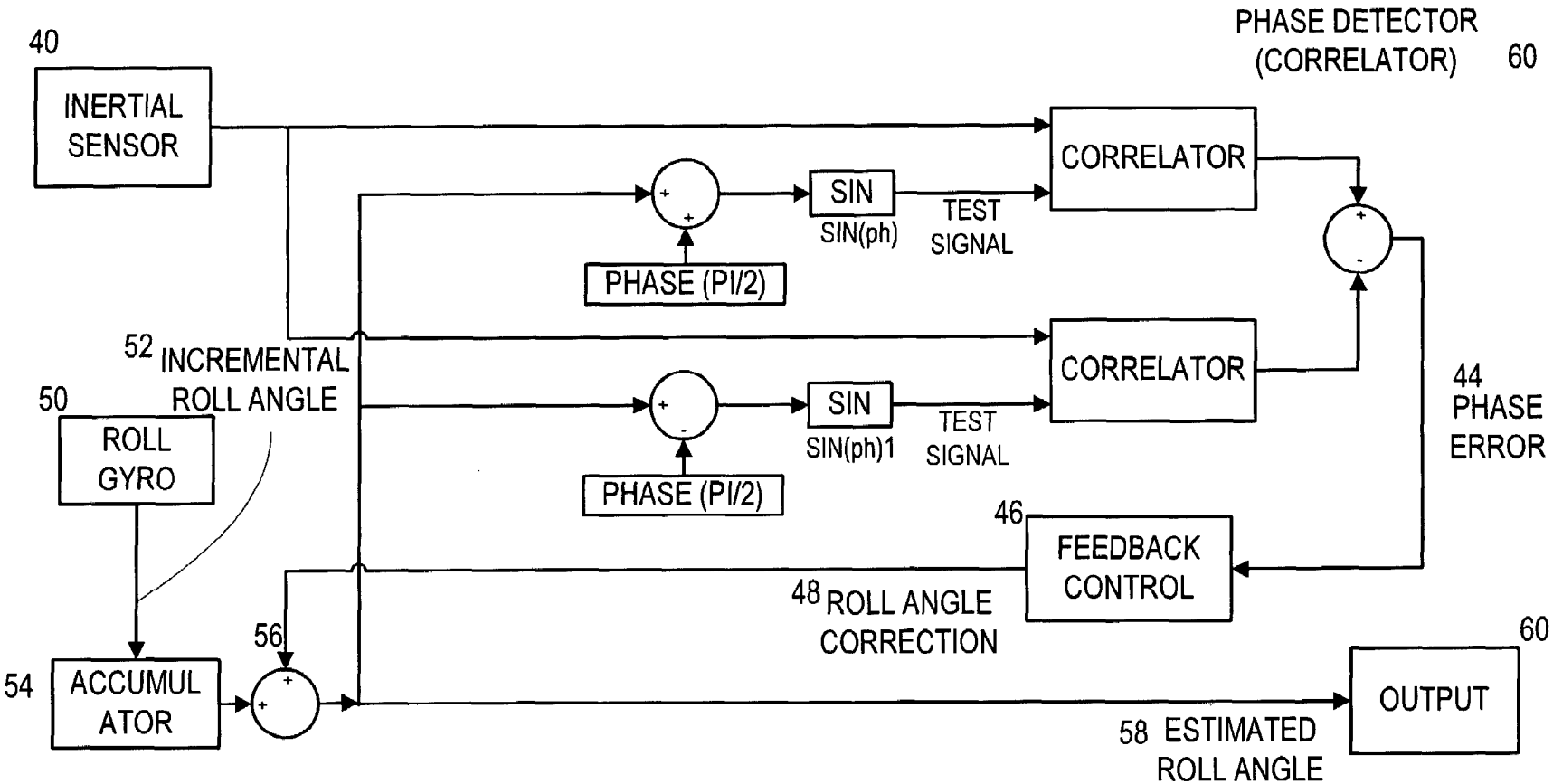
FIG. 5 is a block diagram for the circuit of FIG. 4 utilizing a correlator instead of a PLL as a roll angle detector.

To dampen the effect of the precession/nutation and also smoothen the estimation of the accumulated roll angle, a complementary filter 70 may be inserted after the PLL 30 (FIG. 4) or the correlator 80 (FIG. 5). FIG. 3 illustrates the use of a complementary filter 70. The version of complementary filter 70 used in embodiments of the invention blends the estimated roll angle 58 from the PLL 30 with the roll rate 52 from the roll gyro 50. The roll rate gyro signal 52 has better short-term behavior than the estimated roll angle 58 and is also less affected by the precession/nutation. The primary filtering function is performed by the integrator 74 that inputs the combined roll rate gyro signal 52 and the output of a transfer function H(s) 72. The transition between relying on the short term roll rate behavior and the long term roll angle behavior is determined by the parameters of the transfer function H(s) 72, which (in most cases) is a fixed gain.

By comparing the roll rate 52 from the roll gyro 50 with the complementary filtered roll rate, it is also possible to estimate the roll gyro scale factor error.

The invention shows that it is possible to estimate roll angle and other navigation states with enough accuracy to perform a coarse alignment using the methods described above. Two methods to measure roll angle information, using either gyros or accelerometers have been described.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

List of Reference Characters Update!

| | |
|---|---|
| 10 | projectile |
| 30 | phase-locked loop (PLL); phase detector |
| 32 | inertial sensor signal; sinusoidal measurement signal |
| 33 | four-quadrant arctan function |
| 34 | estimated roll angle |
| 35, 35' | low pass filter |
| 36 | sine function |
| 36' | cosine function |
| 37, 37' | multiplier |
| 38, 38' | multiplied signals |
| 39, 39' | sinewaves |
| 40 | inertial sensor; rotation sensing device (e.g., accelerometer, pitch/yaw gyro) |
| 44 | phase error |
| 46 | feedback loop control |
| 48 | correlator control loop phase correction |
| 52 | Incremental roll angle |
| 54 | accumulator for roll incremental angle |
| 56 | adder |
| 58, 58' | estimated roll angle |
| 60 | output |
| 70 | complementary filter |
| 72 | filter transfer function |
| 80, 80' | correlator; phase detector; correlator components |
| r | distance from longitudinal axis to rotation sensing device |

What is claimed is:

1. An apparatus for estimating a rotation angle in a spinning projectile, comprising:

an inertial sensor comprising a signal output that outputs a rotation signal related to a rate of rotation about the longitudinal axis;

a phase detector comprising an input connected to the signal output of the inertial sensor, the phase detector further comprising an output at which a phase error between the rotation signal and a test signal, the test signal being derived by the phase detector, is provided, the phase detector being configured to reduce the phase error to zero via a feedback path; and an output connected to the output of the phase detector at which an estimated rotation angle is provided.

2. The apparatus according to claim 1, wherein the phase detector is a phase-locked loop (PLL).

3. The apparatus according to claim 2, wherein the PLL is a Costas loop.

4. The apparatus according to claim 1, wherein the phase detector is a correlator.

5. The apparatus according to claim 4, wherein the phase detector comprises two correlator components, each comprising:

a test signal input;

a rotation signal input; and a driving mechanism configured to drive a correlator output until the correlator output lies symmetrical around a midpoint of a correlator window indicating that a phase of the rotation signal coincides with a phase of the estimated rotation angle.

6. The apparatus according to claim 1, further comprising:

a complementary filter comprising an input at which the estimated rotation angle is provided, an input at which a rotation rate is provided, and an output at which an enhanced estimated rotation angle is provided.

7. The apparatus according to claim 6, wherein the complementary filter further comprises:

a transfer function component having an input at which the estimated rotation angle and enhanced estimated rotation angle are present; and an integrator at which the rotation rate and output of the transfer function component are present.

8. The apparatus according to claim 7, wherein the transfer function component is at a minimum a gain function.

9. The apparatus according to claim 1, wherein the inertial sensor is an accelerometer mounted away from a longitudinal axis of the projectile and with its input axis in the direction of the longitudinal axis.

10. The apparatus according to claim 1, wherein the inertial sensor is a gyroscope with the input axis perpenticular to the longitudinal axis of the projectile.

11. The apparatus of claim 1, wherein the estimated rotation angle is an estimated roll angle.

12. A method for estimating a roll angle in a spinning projectile, comprising:

providing an inertial sensor on the projectile;

launching the projectile in a ballistic trajectory, causing the projectile to spin about a longitudinal axis of the projectile;

producing a rotation signal by the inertial sensor in response to the spin;

inputting the rotation signal to a phase detector;

producing a phase error between the rotation signal and a test signal with the phase detector;

reducing the phase error to zero by providing a phase correction via a feedback path for the phase error; and outputting an estimated roll angle to an external system output.

13. The method according to claim 12, wherein the phase detector is a phase-locked loop (PLL).

14. The method according to claim 13, wherein the PLL is a Costas loop.

15. The method according to claim 12, wherein the phase detector is a correlator.

16. The method according to claim 15, wherein the phase detector comprises two correlator components, for each, the method comprising:

generating a sinusoidal test signal and providing the sinusoidal test signal as an input to the correlator component;

inputting the rotation signal at a further input of the correlator component; and driving a correlator output until the correlator output lies symmetrical around a midpoint of a correlator window indicating that a phase of the rotation signal coincides with a phase of the estimated roll angle.

17. The method according to 12, wherein outputting the estimated roll angle to an external system output further comprises:

outputting the estimated roll angle to a complementary filter;

enhancing the estimated roll angle with the complementary filter to dampen at least one of precession or nutation effects and smoothen the estimated roll angle; and outputting the enhanced estimated roll angle to the external system output.

18. The method according to claim 17, wherein enhancing the estimated roll angle further comprises:

inputting, to a transfer function component of the complementary filter, the estimated roll angle and enhanced estimated roll angle; and inputting, to an integrator of the complementary filter a roll rate and output of the transfer function component.

19. The method according to claim 18, wherein the transfer function component is at a minimum a gain function.

* * * * *